US005105217A

United States Patent [19]

Igawa

[11] Patent Number: 5,105,217

[45] Date of Patent: Apr. 14, 1992

[54] COPYING APPARATUS WITH GRID FORMING FUNCTION

[75] Inventor: Shoji Igawa, Osaka, Japan

[73] Assignee: Minolta Camera Kabushiki Kaisha, Osaka, Japan

[21] Appl. No.: 260,804

[22] Filed: Oct. 21, 1988

[30] Foreign Application Priority Data

Oct. 21, 1987 [JP] Japan ..... 62-267440

[51] Int. Cl.[5] ..... G03G 21/00

[52] U.S. Cl. ..... 355/202; 355/311; 355/326

[58] Field of Search ..... 355/200, 202, 218, 326, 355/327, 311

[56] References Cited

U.S. PATENT DOCUMENTS 4,640,601 2/1987 Deguchi et al. ..... 355/218
4,685,794 8/1987 Watanabe ..... 355/218
4,742,373 5/1988 Nakatani ..... 355/202
4,752,809 6/1988 Ito ..... 355/202
4,845,524 7/1989 Okamoto et al. ..... 355/218 X
4,891,287 1/1990 Toyoshi et al. ..... 355/218 X

FOREIGN PATENT DOCUMENTS 60-212778 10/1925 Japan .

*Primary Examiner*—Fred L. Braun
*Attorney, Agent, or Firm*—Price, Gess & Ubell

[57] ABSTRACT

A copying apparatus is provided with a grid forming function wherein a grid pattern can be formed on plain copy paper to accurately and readily indicate the size or position of an image formed thereon. The copying apparatus includes a photosensitive member, a writing head including a plurality of linear writing elements, a driving circuit for driving the writing elements, a control system for controlling the driving circuit to cause the driving circuit, and thereby the writing head, to form an electrostatic image of a grid pattern on the photosensitive member, a developer for developing the electrostatic image to form a toner image of the grid pattern, and a transfer device for forming the grid pattern toner image onto a copy paper.

16 Claims, 15 Drawing Sheets

COPYING APPARATUS WITH GRID FORMING FUNCTION

FIELD OF THE INVENTION

The present invention relates to a copying apparatus operable to form a squared pattern image on copying paper.

BACKGROUND OF THE INVENTION

Copying paper, when ruled into squares, accurately and readily indicates the size or position of an image formed thereon, hence convenience. Accordingly, it has been practice to use graph paper or squared paper as copying paper and form images thereon.

However, when this method is used for copying operation, there arises a need to prepare the squared paper which is more expensive than plain paper and accommodate the squared paper in the supply cassette to be attached to the copying machine. Furthermore, the paper must be replaced by the plain paper when the latter paper is to be used. The method therefore involves the problem of being cumbersome.

SUMMARY OF THE INVENTION

Accordingly, the primary object of the present invention is to provide a copying apparatus operable to form a grid or squared pattern image on copying paper.

Another object of the invention is to provide a copying apparatus adapted to form on copying paper a squared pattern and a copy image as superposed thereon.

Another object of the invention is to provide a copying apparatus operable to form a squared pattern which has a color substantially the same as that of copying paper.

In a copying apparatus for copying an image of an original document on paper, the foregoing objects of the present invention can be well fulfilled by the improvement comprising:

a photosensitive member, a writing head including a plurality of writing elements arranged in a line, drive means for selectively and independently driving the writing elements, control means for controlling the drive means so as to form an electrostatic image of a squared pattern on the photosensitive member, developing means for developing the electrostatic image to thereby form a toner image of the squared pattern on the photosensitive member, and transfer means for transferring the toner image onto paper.

Another aspect of the present invention is a copying machine comprising:

a photosensitive member, a document table for supporting an original document, optical means for projecting an image of the original document onto the photosensitive member, a writing head including a plurality of writing elements arranged in a line and selectively and independently operable for projecting light onto the photosensitive member, first image forming means for forming a first electrostatic image on the photosensitive member by the optical means, second image forming means for forming a second electrostatic image of a squared pattern on the photosensitive member by the writing head, developing means for developing the first and second electrostatic images to thereby form first and second toner images on the photosensitive member, and transfer means for transferring the first and second toner images onto one side of the paper.

BRIEF DESCRIPTION OF THE DRAWINGS

These and other objects or features of the present invention will become apparent from the following description of a preferred embodiment thereof taken in conjunction with the accompaying drawings, in which:

FIG. 5 (B) is a flow chart showing a key input processing subroutine;

FIGS. 5 (C) and (D) are flow charts showing a copying operation processing subroutine;

In the following description, like parts are designated by like reference numbers throughout the several drawings.

DESCRIPTION OF THE PREFERRED EMBODIMENT

An embodiment of the invention will be described below.

Figure 1:
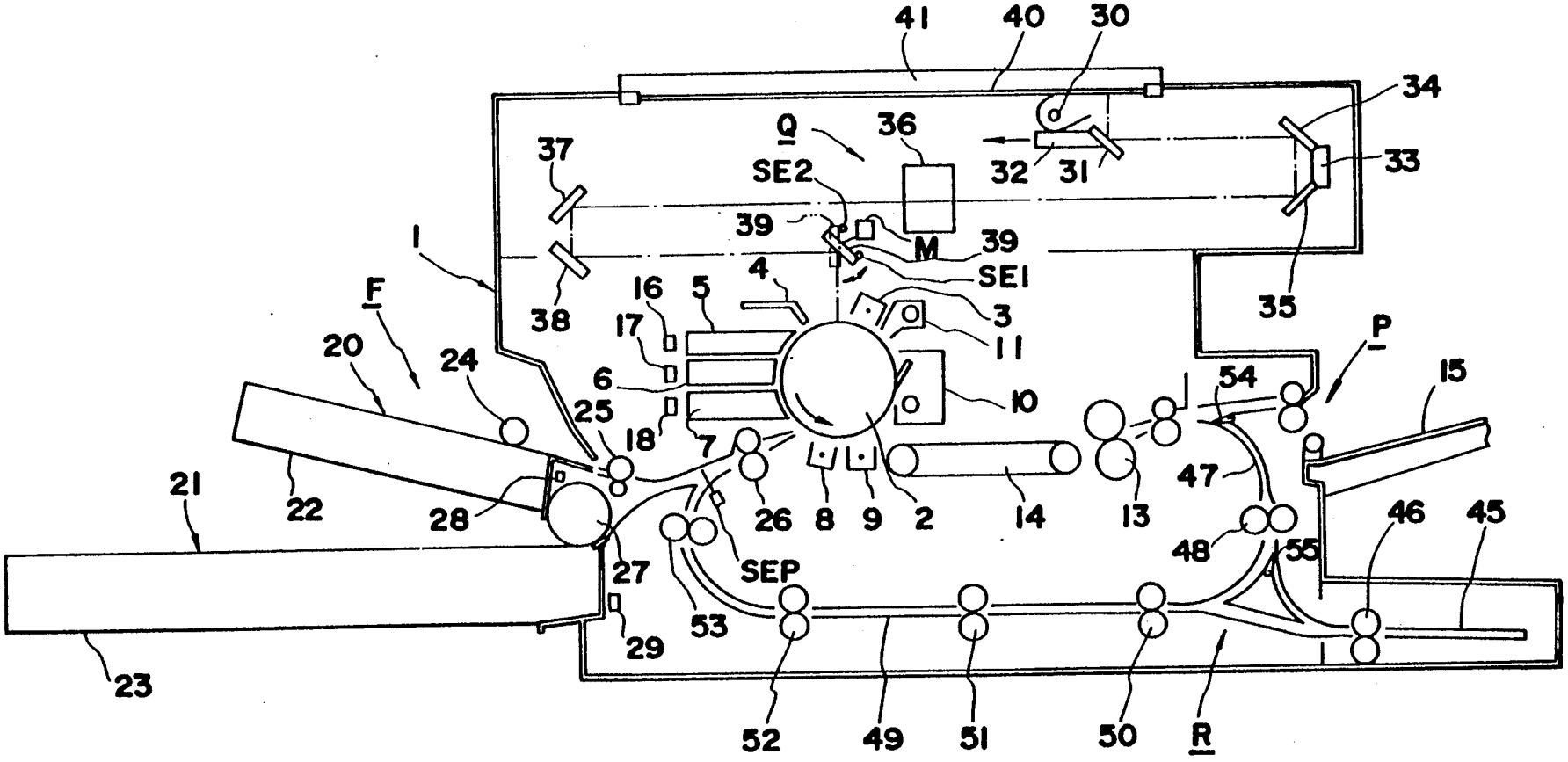
FIG. 1 is a sectional view schematically showing the construction of a copying apparatus embodying the invention.
Figure 2:
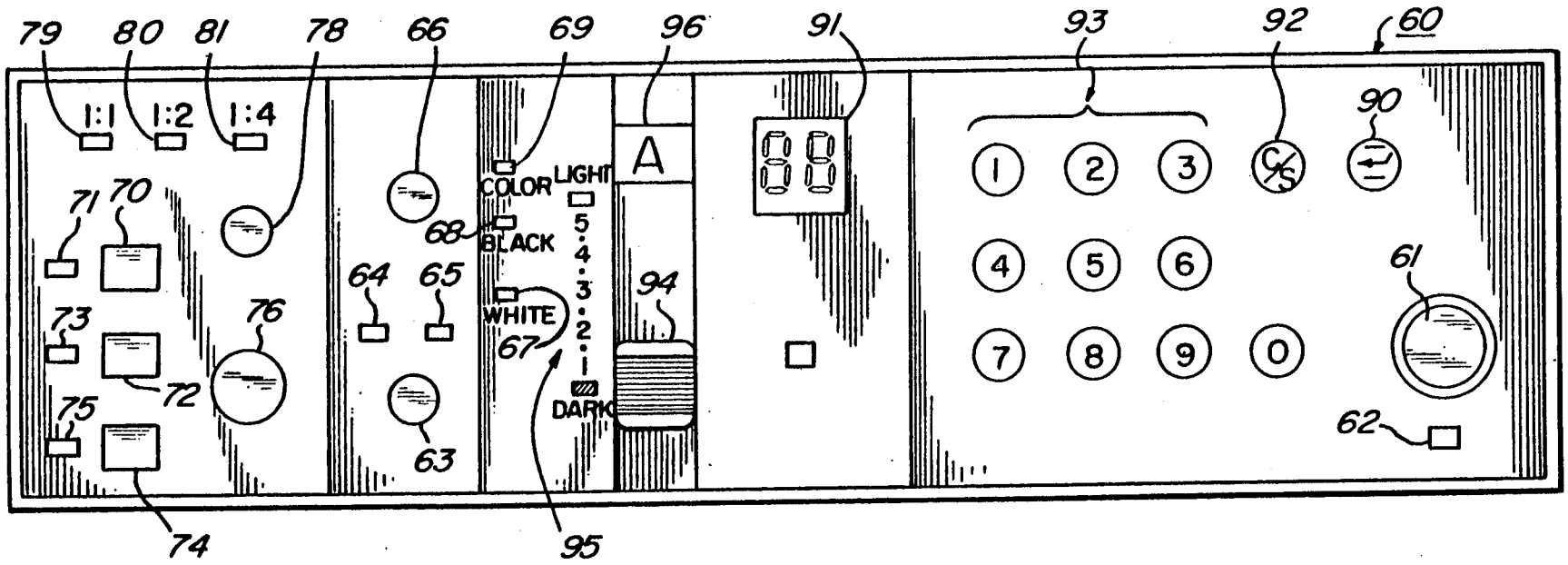
FIG. 2 is a front view schematically showing the operation panel of the apparatus.

FIG. 1 is a sectional view schematically showing the construction of a copying apparatus embodying the invention, and FIG. 2 is a front view showing the operation panel.

With reference to FIG. 1, the body 1 of the copying apparatus has a photosensitive drum 2 disposed therein approximately centrally thereof. The drum 2 is drivingly rotatable counterclockwise by a main motor (not shown). Arranged around the drum 2 along the direction of rotation thereof are a sensitizing charger 3, inter-image eraser 4, first to third developing units 5 to 7, transfer charger 8, separating charger 9, cleaner 10 and main eraser 11. A paper feed system F is provided to the left of the drum 2, and a paper discharge system P including a fixing unit 13 is disposed to the right thereof. An optical system Q is provided above the drum 2, and a duplex-composite system R below the drum 2.

The paper feed system F comprises a first feeder 20 and a second feeder 21. A first paper cassette 22 and a second paper cassette 23 having copying paper accommodated therein are provided in the feeders 20 and 21, respectively. The copying paper delivered from the first cassette 22 by a first feed roller 24 is passed over an intermediate roller 25 and sent to a timing roller 26. On the other hand, the paper sent out from the second cassette 23 by a second feed roller 27 is directly transported to the timing roller 26. A paper edge sensor SEP for detecting the leading edge and trailing edge of the copying paper is disposed immediately upstream from the timing roller 26 with respect to the direction of transport of the paper. These rollers 24 to 27 are disconnectably coupled, each by an unillustrated clutch, to a drive system coupled to the main motor.

The feeders 20, 21 are provided in the vicinity thereof with paper color sensors 28, 29, respectively, for detecting the color of copying paper accommodated in the cassettes 22, 23. Although not shown, each feeder is also provided with a size sensor for detecting the size of the paper, and an absence sensor for detecting that the paper in the cassette has been consumed. Each of the paper color sensors 28, 29 comprises a plurality of magnets arranged on the cassette for different paper colors and a plurality of reed switches for detecting the respective magnets and is adapted to identify the color of the paper in the cassette, for example, "white" by an on-off combination of the reed switches. The construction of the sensors 28, 29 is not limited to the above but can be any one insofar as the sensor functions to identify and detect the color of the paper accommodated in the cassette.

The optical system Q comprises a scanning unit 32 comprising an exposure lamp 30 and a first mirror 31 as an assembly, second and third mirrors 34, 35 held by a common holder 33, a projection lens 36 movable with a variation in copying magnification, fourth and fifth mirrors 37, 38 shiftable and pivotally movable with a variation in copying magnification, and a sixth mirror 39 supported pivotally movably. The sixth mirror 39 is pivotally movable by drive means M between an initial position indicated in solid line in FIG. 1 and a specified position indicated in broken line. An image of an original obtained by the light from the exposure lamp 30 is projected onto the photosensitive drum 2 when the sixth mirror 39 is in the initial position but is not transmitted to the drum 2 when the mirror 39 is in the specified position. The sixth mirror 39, when in the initial position or in the specified position, is detected by a corresponding sensor SE1 or SE2.

With the above apparatus, the surface of the drum 2 is negatively charged by the charger 3, then the exposure lamp 30 is turned on and the scanning unit 32 is caused to scan the original by being moved from its waiting position leftward in FIG. 1, whereby an electrostatic latent image is formed on the drum surface in corresponding relation with the original image illuminated with the lamp 30. During this process, the charge is removed by the inter-image eraser 4 from the drum surface area, other than the image area, from the portion thereof corresponding to the front end (with respect to the scanning direction) of the original to the portion thereof corresponding to the original rear end.

The latent image formed on the surface of the drum 2 is made visible (developed) by the deposition of a toner of positive polarity supplied by one of the developing units 5 to 7, whereby a toner image is formed on the drum surface. Subsequently, copying paper is fed to the drum 2 by the timing roller 26 of the paper feed system F which is operated in timed relation with the scanning unit 32. The toner image is transferred onto the paper by the transfer charger 8. The toner portion remaining on the drum surface after the transfer is removed and collected by the cleaner 10, while the charge remaining on the drum surface is removed by the main eraser 11.

The paper bearing the toner image transferred thereto is separated from the drum 2 by the separating charger 9 and transported by a conveyor belt 14 to the fixing unit 13, by which the toner image is fixed to the paper surface by heating. When the copying apparatus is set in a simplex copy mode, the paper is then delivered directly onto the discharge tray 15.

The duplex-composite system R is used when the copying apparatus is set in a duplex copy mode for making double-faced copies or in a composite copy mode for producing a plurality of images on one surface of copying paper as a composite image.

The duplex-composite system R has a refeed paper cassette 45 for use in the duplex copy mode for temporarily accommodating copying paper having an image formed on its one surface. The refeed cassette 45 is provided with a pickup roller 45 for use in accommodating the paper and refeeding the paper. In the duplex copy mode, the paper discharged from the fixing unit 13 is transported by a transport roller 48 to the pickup roller 46 through a paper feed channel 47 defined by guide plates and accommodated in the cassette 45. The paper is then delivered from the cassette 45 by the pickup roller 46 and transported to the timing roller 26 again by first to fourth transport rollers 50 to 53 through a paper refeed channel 49 defined by guide plates extending from the roller 46 to the timing roller 26 of the paper feed system F. The rollers 46, 48 and 50 to 53 are disconnectably coupled, each by an unillustrated clutch, to the drive system coupled to the main motor.

In the composite copy mode, the paper discharged from the fixing unit 13 is transported to the timing roller 26 directly via the channels 47 and 49.

The path of transport of the paper is changed over for the above different copy modes by switch pawls 54 and 55 disposed immediately downstream of the fixing unit 13 and the transport roller 48, respectively, with respect to the direction of transport of the paper. The switch pawls 54, 55 are connected to solenoids SL1, SL2. The switch pawl 54 is positioned to transport the paper onto the tray 15 when the solenoid SL1 is deenergized, or is alternatively positioned to transport the paper into the channel 47 when the solenoid is energized. The switch pawl 55 is positioned to transport the paper from the channel 47 directly into the channel 49 when the solenoid SL2 is deenergized, or is alternatively positioned to transport the paper into the cassette 45 when the solenoid is energized.

The developing units 5 to 7 are provided with toner color sensors 16 to 18 each in the vicinity thereof. Each of the sensors comprises a plurality of reed switches for individually detecting a plurality of magnets provided for different toner colors to identify the color of the toner in the developing unit, for example, "white," "black" or other color by an on-off combination of the reed switches. The construction of the toner color sensors 16 to 18 is not limited to the above but can be any one insofar as the sensor functions to identify and detect the color of the toner in the developing unit.

The copying apparatus has an operation panel 60 shown in FIG. 2. The operation panel 60 has a print key 61 for giving an instruction to start a copying operation, LED 62 for indicating that the key has been depressed, feeder selecting key 63 for selecting one of the first and second feeders 20 and 21 for supplying copying paper, LED 64 for indicating the first feeder 20 as selected, LED 65 for indicating the second feeder 21 as selected, developing unit selecting key 66 for selecting one of the first to third developing units 5 to 7, LEDs 67 to 69 provided for the respective developing units 5 to 7 for indicating the color of the toner in the selected unit, duplex mode key 70 for setting the copying apparatus in the duplex copy mode as selected, LED 71 for indicating this mode as selected, composite mode key 72 for selecting the composite copy mode, LED 73 for indicating this mode as selected, simplex mode key 74 for selecting the simplex copy mode, LED 75 for indicating this mode as selected, squared pattern mode key 76 for selecting a copy mode for forming a squared pattern on the copying paper, square size selecting key 78 for selecting one of the square sizes to be described later, and LEDs 79 to 81 provided for the different square sizes for indicating the size selected. Besides these keys and LEDs, also provided on the operation panel 60 are an interrupt key 90, copy number display 91 comprising LEDs providing seven-segment elements, clear/stop key 92 for interrupting copying operation or multicopying operation (for continually producing a plurality of copies from a single orginal) and clearing the copy number setting, ten number entry keys 93 for setting the desired number of copies to be made, exposure setting key 94 for manually adjusting the amount of exposure to be given by the exposure lamp 30, a group of LEDs 95 for indicating the adjusted amount of exposure, automatic exposure selecting key 96 for selecting an automatic exposure mode wherein a proper amount of exposure is automatically adjusted for the original to be copied, etc. The keys on the operation panel other than the squared pattern mode key 76 are in on-state while the key is depressed by the operator but is in off-state otherwise, whereas the squared pattern mode key 76, once depressed, is held in on-state until it is depressed again.

Figure 3:
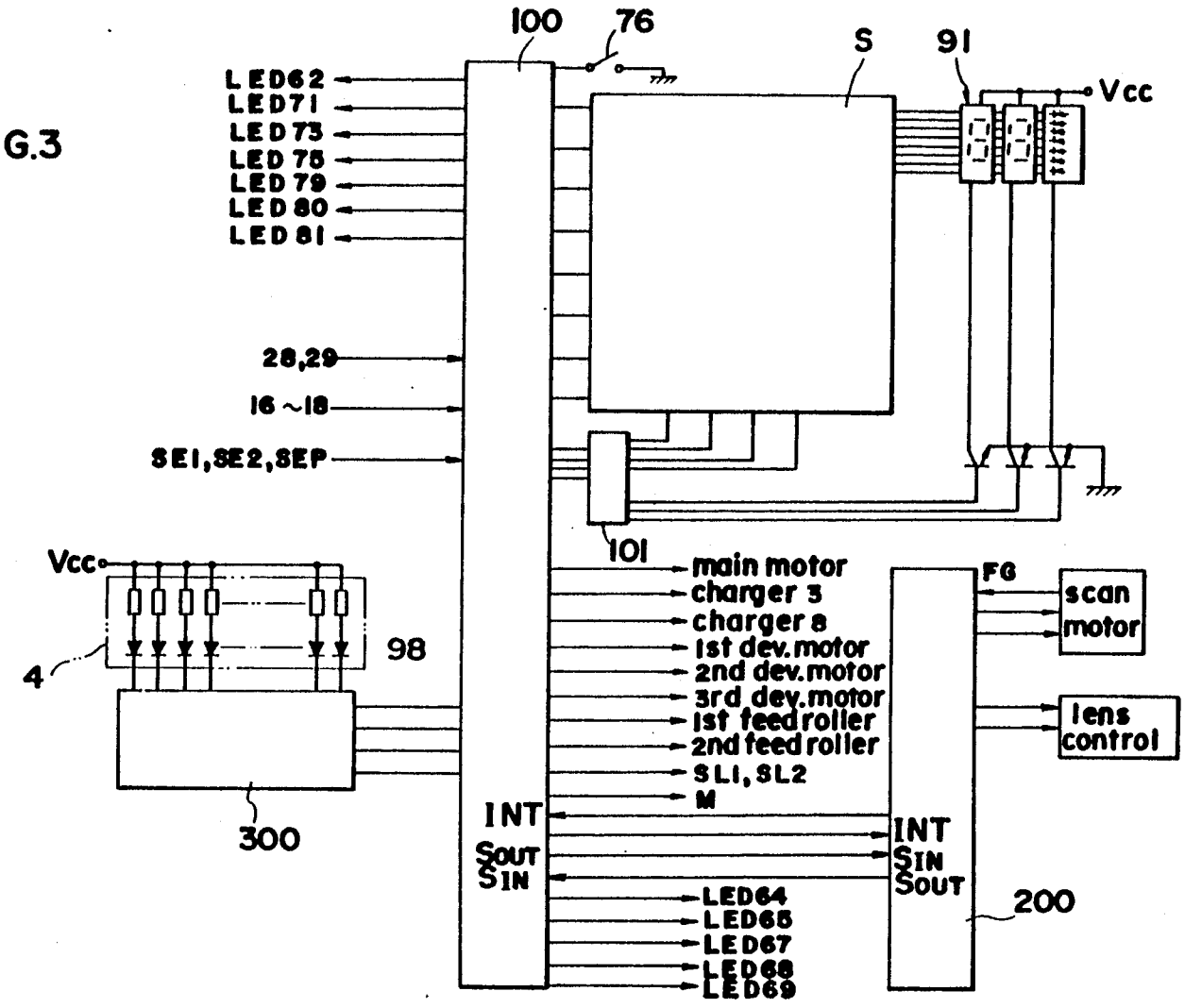
FIG. 3 is a diagram showing the input-output circuit of a microcomputer incorporated in the apparatus.

The copying apparatus further has incorporated therein a microcomputer having an input-output circuit shown in FIG. 3. The microcomputer has a first CPU 100 and a second CPU 200. The first CPU has connected thereto the squared pattern mode key 76 and a switch matrix S including the above-mentioned keys or switches and sensors on the operation panel 60. The main motor and various rollers and clutches are operated under the control of the first CPU 100 in response to the manipulation of such keys and the operation of the sensors. The first CPU 100 has also connected thereto the LEDs constituting the copy number display 91, etc. via a decoder 101, and LEDs for indicating the different copy modes. The first CPU 100 receives paper color detection signals from the paper color sensors 28, 29, toner color detection signals from the toner color sensors 16 to 18, detection signals from the mirror position sensors SE1, SE2, and a copying paper leading or trailing edge detection signal from the paper edge sensor SEP.

On the other hand, the second CPU 200 has connected thereto the switches associated with the operation of the scanning unit 32, etc. and primarily controls the optical system Q. The first CPU 100 and the second CPU 200 are interconnected by a bus line for a synchronized operation.

Figure 4:
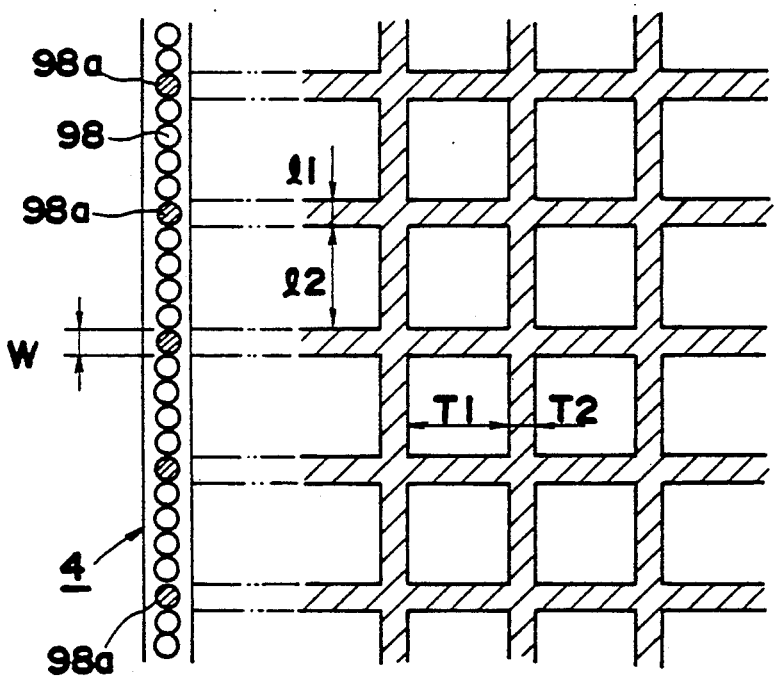
FIG. 4 is a diagram schematically showing the construction of an inter-image eraser and the function thereof.

FIG. 4 is a diagram schematically showing the construction and function of the inter-image eraser 4. The eraser 4 is provided in position around the drum 2 as seen in FIG. 1 and functions to remove the unnecessary charge from the drum surface area other than the image area in the usual copying operation. The eraser 4 has 32 light-emitting diodes 98 arranged in a row longitudinally of the drum 2. These light-emitting diodes 98 are connected to the first CPU 100 via a serial-parallel conversion IC 300 as seen in FIG. 3 and are so controlled as to be selectively turned on or off in accordance with four kinds of signals, i.e., strobing signal, latching signal, data signal and clock signal, delivered from the first CPU 100. The IC 300, which operates to convert serial data from the first CPU 100 to parallel data, repeats the following four operations to control the operation of the eraser 4.

(1) Upon the rise of a clock pulse, the IC 300 stores the data signal from the CPU in unillustrated shift registers (8-bit) in the IC. The IC has four shift registers for controlling the 32 light-emitting diodes 98.

(2) In response to the strobing signal from the CPU, the data is transferred from the shift registers to a latching circuit.

(3) In response to the latching signal from the CPU, the data in the circuit is latched, and the desired light-emitting diodes 98 are turned on in accordance with the latched data.

Next with reference to the flow charts of FIGS. 5 to 11, the control operation of the first CPU 100 constituting the microcomputer will be described.

Main Routine

Figure 5A:
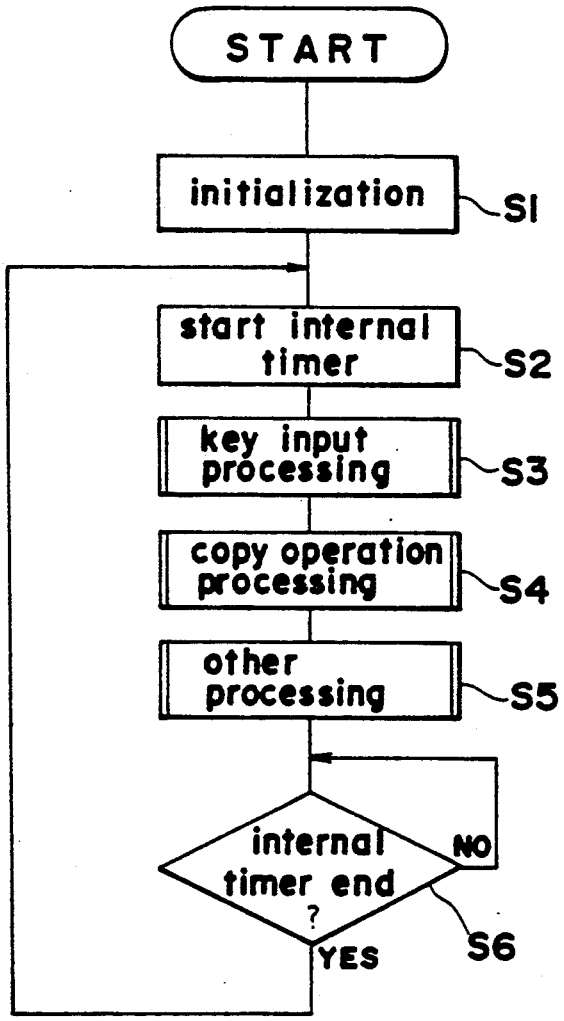
FIG. 5 (A) is a flow chart showing the main routine of a program for controlling the copying apparatus.
Figure 5B:
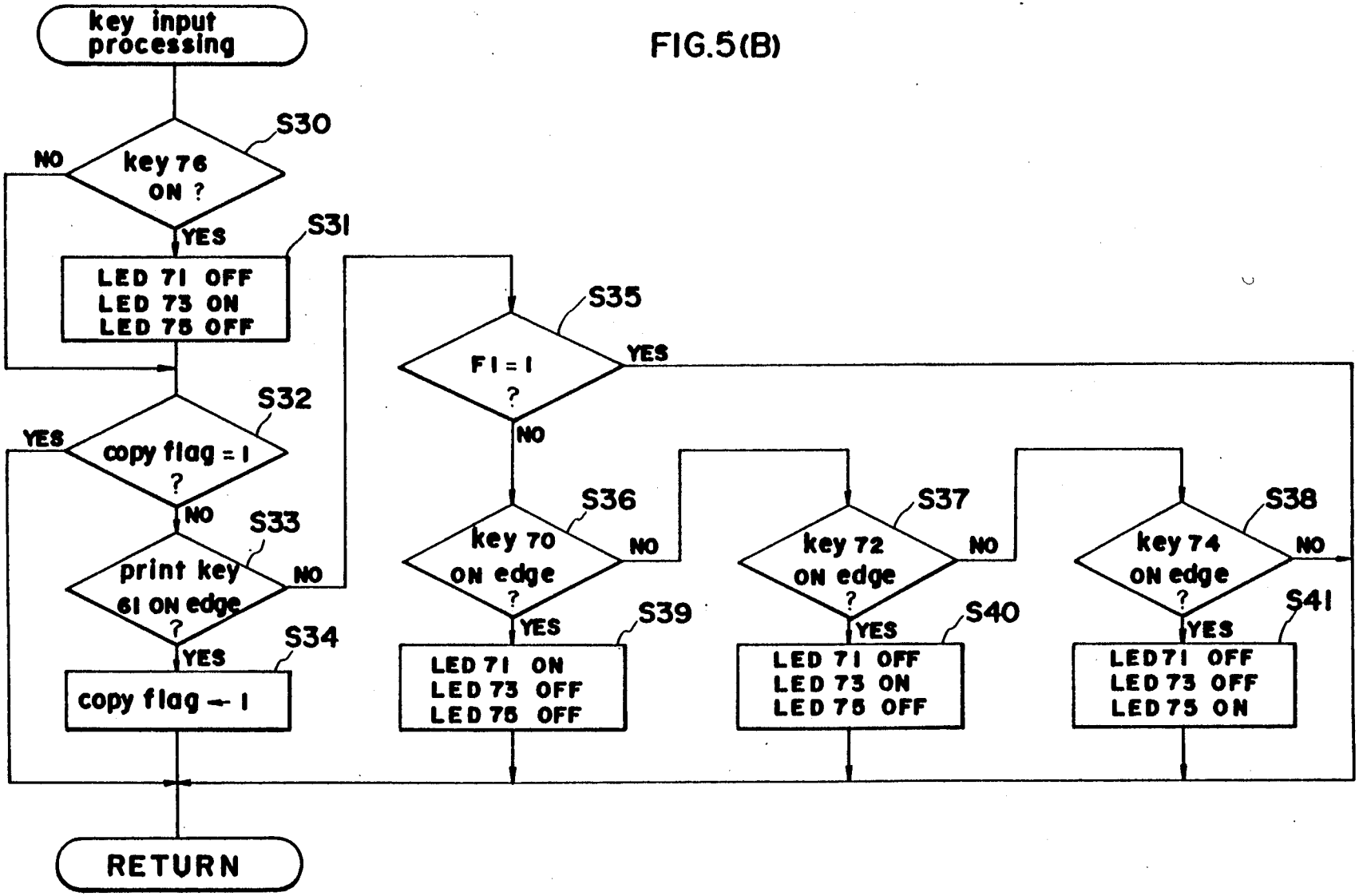
Figure 5:
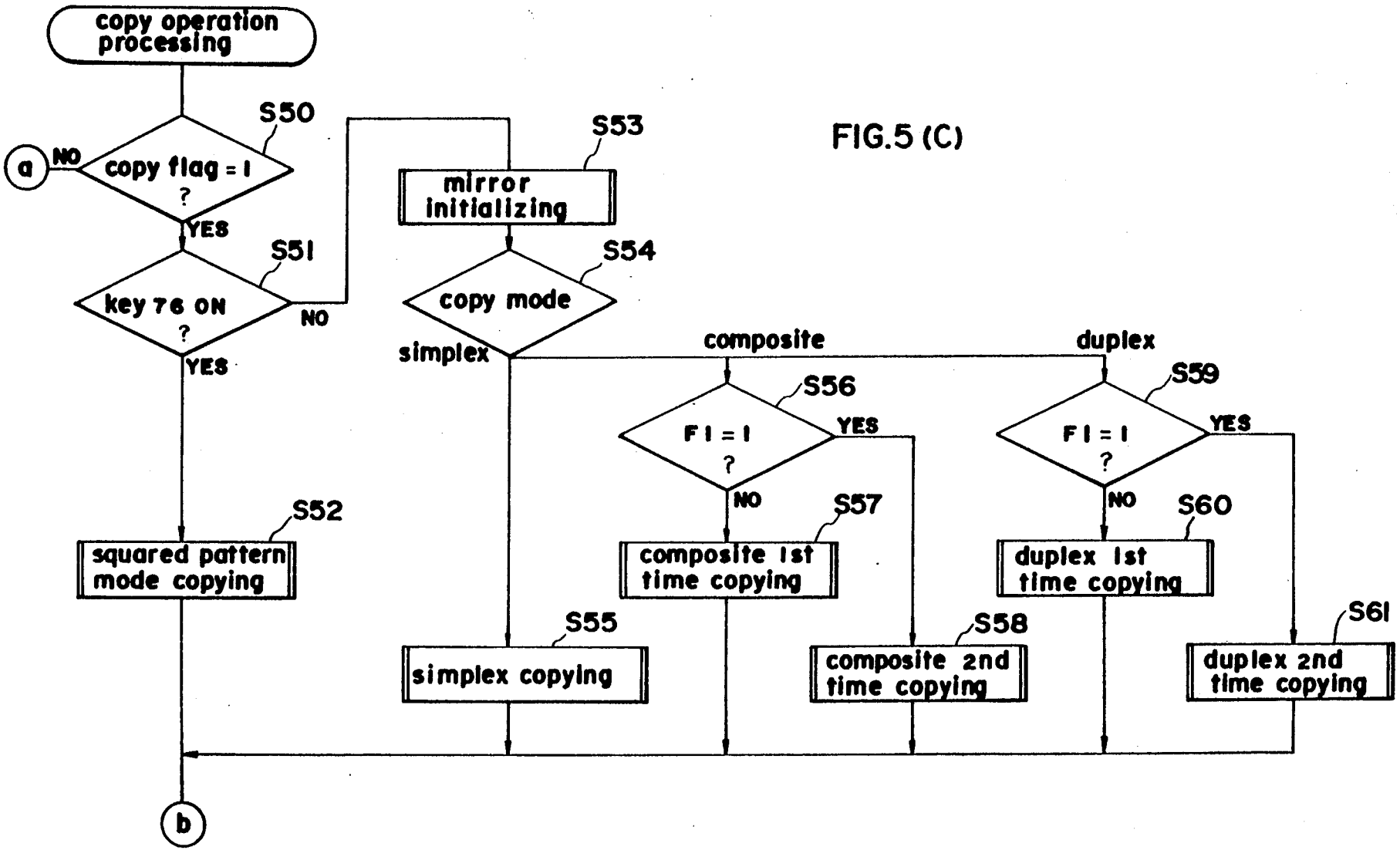
Figure 5D:
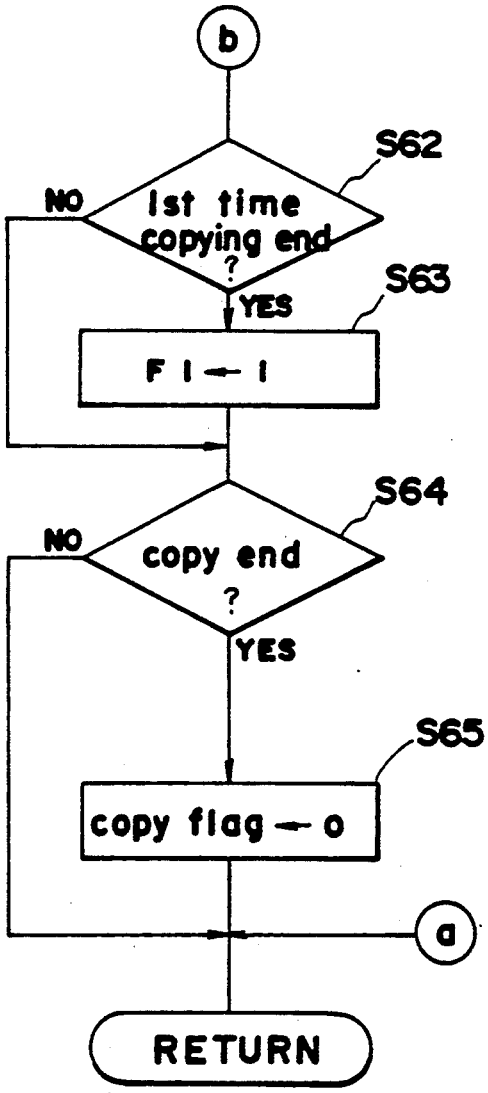

FIG. 5 (A) is a flow chart showing the main routine of the program for controlling the copying apparatus.

When the power supply is turned on to start the program, the first and second CPUs 100 and 200 are initialized in step S1 to set the copying apparatus in the standard copy mode and initialize components and flags.

In step S2, an internal timer is set to start its operation. The internal timer determines a definite processing time for the overall routine independently of the processes of the respective subroutines to be described below. The timers for the subroutines are operated based on this time unit for one routine as a standard.

Steps S3 and S4 are a key input processing subroutine and a copying operation processing subroutine, respectively. These subroutines will be described in detail later.

In step S5, other processes are executed, e.g., a subroutine wherein the temperature of the fixing unit 13 is controlled. This step is followed by step S6.

Step S6 checks the internal timer for the completion of its operation. On completion of the timer operation, the sequence returns to step S1.

Key Input Processing Subroutine

FIG. 5 (B) is a flow chart showing step S3, i.e., the key input processing subroutine.

In step S30, the squared pattern mode key 76 is checked. If the key 76 is on, the sequence proceeds to step S31 to set the apparatus in the same copy mode as the composite copy mode, wherein the LED 73 is turned on. Step S32 then follows. When the key 76 is off, step S31 is jumped. Step 32 checks whether a copy flag is "1". When the flag is "1", indicating that the apparatus is in copying operation, the sequence returns to the main routine without acception of any key input. If the copy flag is not "1", step S33 inquires whether the print key 61 has been depressed. When the answer is affirmative, the copy flag is set to "1" in step S34, whereupon the sequence returns to the main routine. When the answer is negative, step S35 follows to check if a first copying end flag F1 is "1". When the flag F1 is "1", i.e., during the period following the completion of the first copy until the completion of the second copy in the composite or duplex copy mode, no key input is accepted; the sequence returns directly to the main routine. If the flag F1 is not "1", step S36, S37 or S38 is performed to check whether the duplex, composite or simplex mode key 70, 72 or 74 has been depressed to set the corresponding copy mode and correspondingly turn on or off the LEDs 71, 73 and 75 (step S39, S40 or S41).

Copying Operation Processing Subroutine

FIGS. 5 (C) and 5 (D) are flow charts showing the copying operation processing subroutine of step S4.

Step S50 inquires whether the copy flag is "1". If it is not "1", the sequence returns directly to the main routine. If it is "1", step S51 follows which inquires whether the squared pattern mode key 76 is on. When the key is on, step S52 is performed for a copying operation in the squared pattern mode. The squared pattern mode copying subroutine of step S52 will be described later. On the other hand, if the key 76 is off, step S53 follows, in which the sixth mirror 39 is set in the initial position (solid-line position in FIG. 1) and thereby made ready for projecting an image of the original onto the drum 2. Subsequently, step S54 identifies the current copy mode. When the apparatus is in the simplex copy mode, step S55 follows. The sequence proceeds to step S56 in the composite copy mode or to step S59 in the duplex copy mode. In step S55, a process is executed for forming a copy image in the simplex copy mode. In steps S56 and S59, the first copying end flag F1 is checked. If the flag F1 is found to be "1" in step S56, step S57 is performed for conducting the first copying operation in the composite copy mode. If the flag is "1", step S58 is performed for the second copying operation. Similarly, when the flag F1 is "0" in step S59, step S60 follows, whereas if otherwise, step S61 is performed, whereby the first or second copying operation is executed in the duplex copy mode.

The sequence thereafter proceeds to step S62, which inquires whether the first copying operation in the composite, duplex or squared pattern copy mode has been completed. The first copying operation in the squared pattern copy mode means a process for forming a squared pattern on copy paper. When the answer to the inquiry of step S62 is affirmative, the first copying end flag F1 is set to "1" in step S63, followed by step S64 which inquires whether the copying operation has been completed. If the operation has been completed, the copy flag is reset to "0" in step S65. The judgment of the completion of copying operation is made on completion of a sequence of operations to be conducted without depressing the print key 61, so that the copy flag is reset on completion of the first-time copying operation in the composite or duplex copy mode. In the squared pattern copy mode, the copy flag is reset on completion of copying of the original image on the paper after formation of the squared pattern thereon.

Squared Pattern Mode Copying Subroutine

Figure 6:
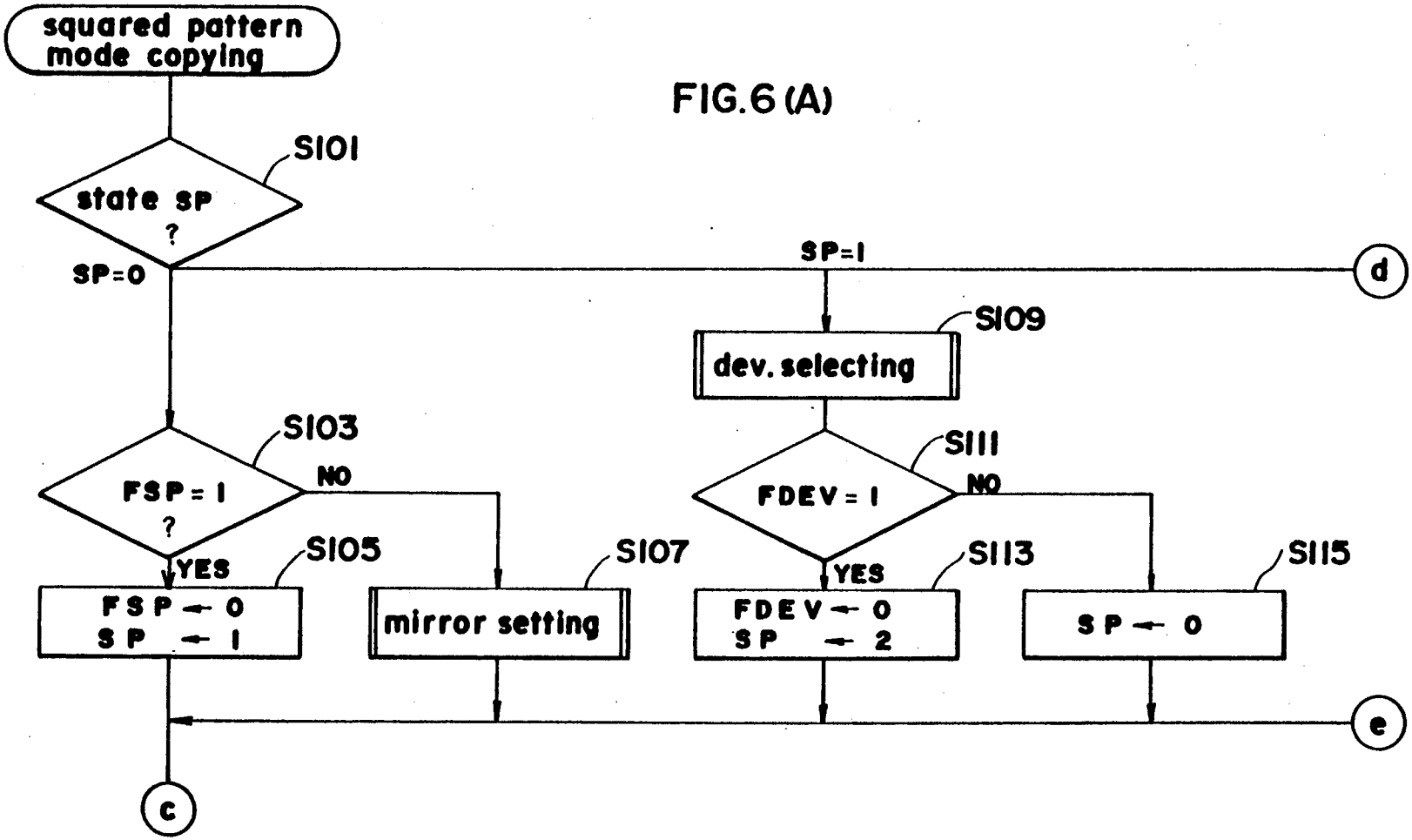
FIGS. 6 (A), (B) and (C) are flow charts showing a squared pattern mode copying subroutine.
Figure 6:
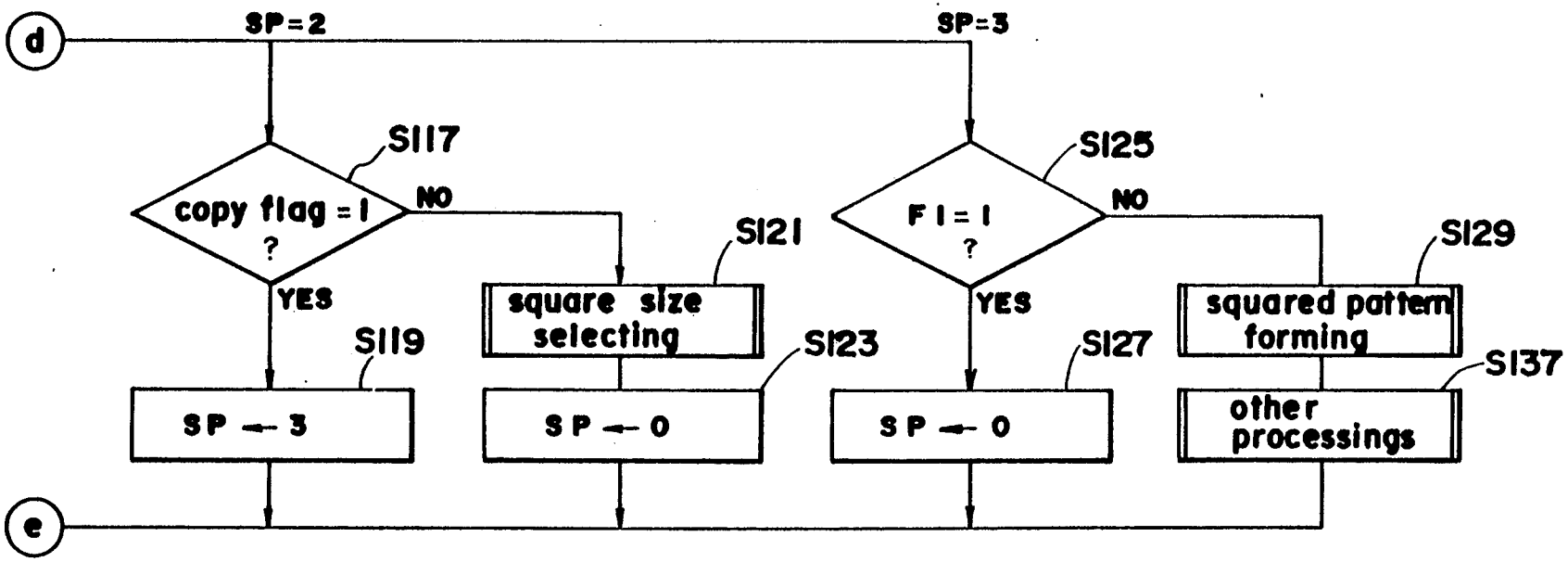
Figure 6C:
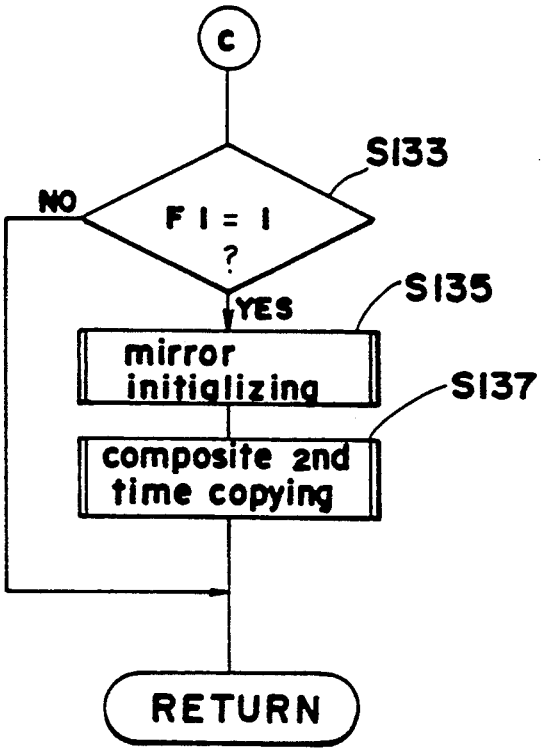

FIGS. 6 (A) and (B) are flow charts showing the squared pattern mode copying subroutine of step S5. This subroutine is divided into four states, which are executed in succession.

Step S101 inquires which of "0" to "3" the state SP is. When the state SP is found to be "0", step S103 checks a flag ESP which indicates whether initialization for the squared pattern mode has been completed. If the flag ESP is "1", indicating the completion of the squared pattern mode setting, the state SP is set to "1" in step S105, followed by step S133. If the mode setting has not been completed in step S103, the mirror setting subroutine to be described later is called in step S107, and the sixth mirror 39 is set in the specified position. The sequence then proceeds to step S133.

When the state SP is found to be "1" in step S101, the developing unit selecting subroutine to be described is called and performed in step S109. Subsequently, step S111 inquires whether a developing unit selecting flag FDEV indicating the selection of the developing unit is set to "1". When the answer is in the affirmative, the flag FDEV is reset to "0", and the state SP is set to "2" in step S113, followed by step S133. If the flag FDEV is not "1" in step S111, the state SP is reset to "0" in step S115, followed by step S133.

When the state SP is found to be "2" in step S101, step S117 inquires whether the copy flag is "1". If it is "1", step S119 sets the state SP to "3", followed by step S133. If otherwise, the square size selecting subroutine to be described later is called in step S121, the state SP is reset to "0" in step S123, and step S133 follows.

Further when the state SP is found to be "3" in step S101, step S125 inquires whether the first copying end flag F1 is "1", i.e., whether the squared pattern formation processing has been completed. When the answer is affirmative, the state SP is reset to "0" in step S127, which is then followed by step S133. If the answer is negative, the squared pattern forming subroutine to be described is called in step S129, and the other processing subroutine in step S131. The sequence then proceeds to step S133.

Step S133 inquires whether the first copying end flag F1 is "1". If it is "1", indicating completion of the squared pattern formation, the mirror setting sub-routine to be described is called in step S135, followed by step S137. In step S137, the same processing as for the second-time copying operation in the composite copy mode is executed to form an image of the original on the paper having the squared pattern already formed thereon. The sequence then returns to the main routine. Unless the flag F1 is "1" in step S133, steps S135 and S137 are jumped for the sequence to return to the main routine.

Mirror Setting Subroutine

Figure 7:
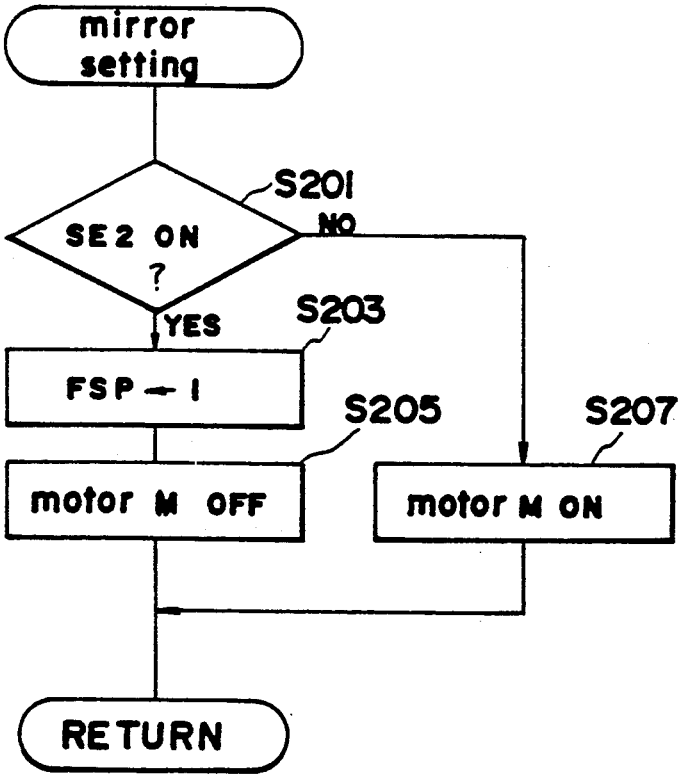
FIG. 7 is a flow chart showing a mirror setting subroutine.

FIG. 7 is a flow chart showing the mirror setting subroutine called in step S107.

Step S201 first inquires whether the mirror position sensor SE2 is on, i.e., whether the sixth mirror 39 is in the specified position (indicated in broken line in FIG. 1). When the mirror 39 is not in the specified position, the motor M is turned on in step S207 for rotating the mirror 39, whereupon the sequence returns to the main routine. When the mirror 39 is in the specified position, the flag FSP is set to "1" in step S203, and the motor M is stopped.

Developing Unit Selecting Subroutine

Figure 8:
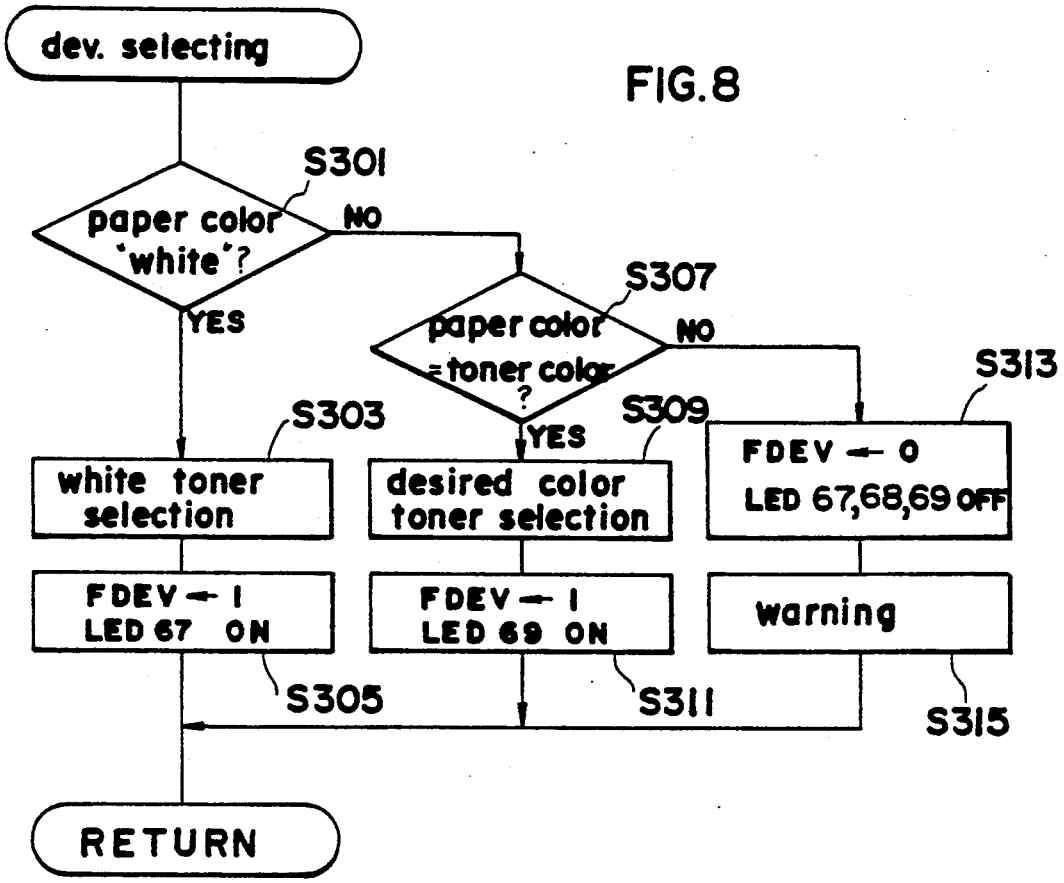
FIG. 8 is a flow chart showing a developing unit selecting subroutine.

FIG. 8 is a flow chart showing the developing unit selecting subroutine called in step S109 for selecting the developing unit containing the toner of the same color as the paper accommodated in the paper cassette selected.

Prior to the execution of this subroutine, the first cassette 22 in the first feeder 20 or the second cassette 23 in the second feeder 21 is selected by depressing the feeder selecting key 63 as the cassette containing the copying paper to be used. One of the LEDs 64 and 65 corresponding to the selected feeder goes on to indicate the selected feeder. Accordingly, when the first cassette 22 of the first feeder 20 is selected, the color of the copying paper in the first cassette 22 is identified, for example, as "white" by the paper color sensor 28, and the resulting detection signal is fed to the first CPU 100. Alternatively if the second cassette 23 of the second feeder 21 is selected as the cassette to be used, a detection signal identifying the color of the paper in the second cassette 23 detected by the paper color sensor 29 is similary fed to the CPU 100.

Step S301 inquires whether the color of the selected paper is "white". If it is "white", step S303 selects the developing unit containing "white" toner having the same color as the selected paper from among the developing units 5 to 7 installed in the copying apparatus. The developing unit selecting flag FDEV is set to "1", and the LED 67 is turned on in step S305, indicating that the "white" toner is selected. The sequence then returns to the main routine. Although a squared pattern of "white" toner will then be formed on "white" paper, it has been ascertained that the pattern is fully visually recognizable for use, while the use of white color obviates the objection that the image formed on the squared pattern appears unsightly. Also useful is a toner of a color similar to the color of "white" paper but slightly differs therefrom, e.g., a "pink" toner which is preapred by admixing a small amount of "red" toner with "white" toner. The use of such a toner produces a contrast between the paper and the squared pattern as well as between the pattern and the original image, giving a more distinct appearance to the copy.

Unless the paper is found to be "white" in step S301, step S307 inquires whether there is any developing unit containing toner of the same color as the paper. If the answer is affirmative, the unit with the toner of the required color is selected in step S310. The developing unit selecting flag FDEV is set to "1" and the corresponding LED 69 is turned on in step S311, whereupon the sequence returns to the main routine. If no developing unit is found available with toner of the same color as the paper in step S307, the developing unit selecting flag FDEV is reset to "0" in step S313. In step S315, the LEDs 67, 68 and 69 are caused to flicker, indicating that none of the developing units 5 to 7 contains the toner of the same color as the paper and is selectable. The sequence then returns to the main routine.

Mirror Initializing Subroutine

Figure 9:
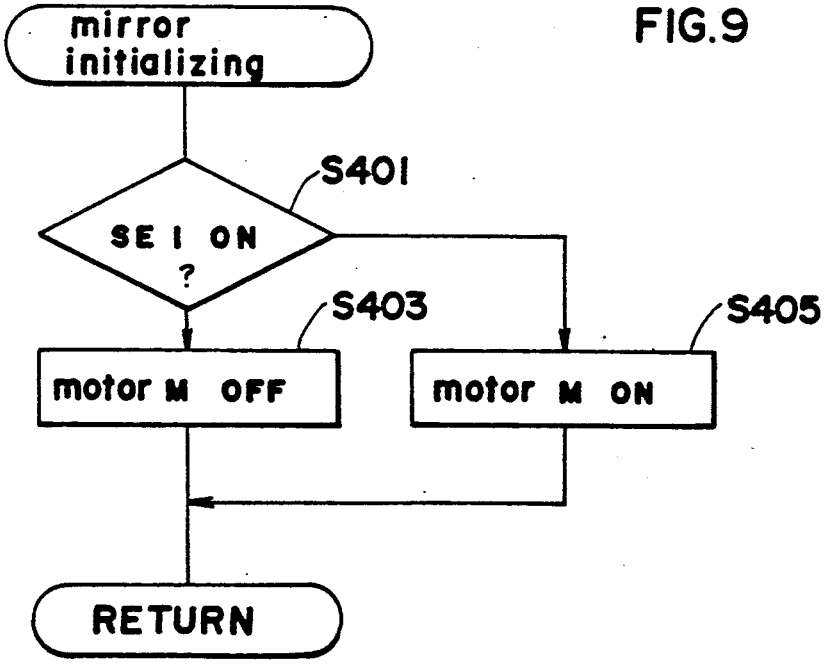
FIG. 9 is a flow chart showing a mirror initializing subroutine.

FIG. 9 is a flow chart showing the mirror initializing subroutine called in steps S53 and S135.

Step S401 inquires whether the mirror position sensor SE1 is on, i.e., whether the sixth mirror 39 is in the initial position (indicated in solid line in FIG. 1) for transmitting the original image onto the drum 2. Unless the mirror 39 is in the initial position, the motor M is energized in step S405 to rotate the mirror 39 toward the initial position. The sequence then returns. Upon the mirror 39 reaching the initial position, the motor M is deenergized in step S403, whereupon the sequence returns.

Square Size Selecting Subroutine

Figure 10:
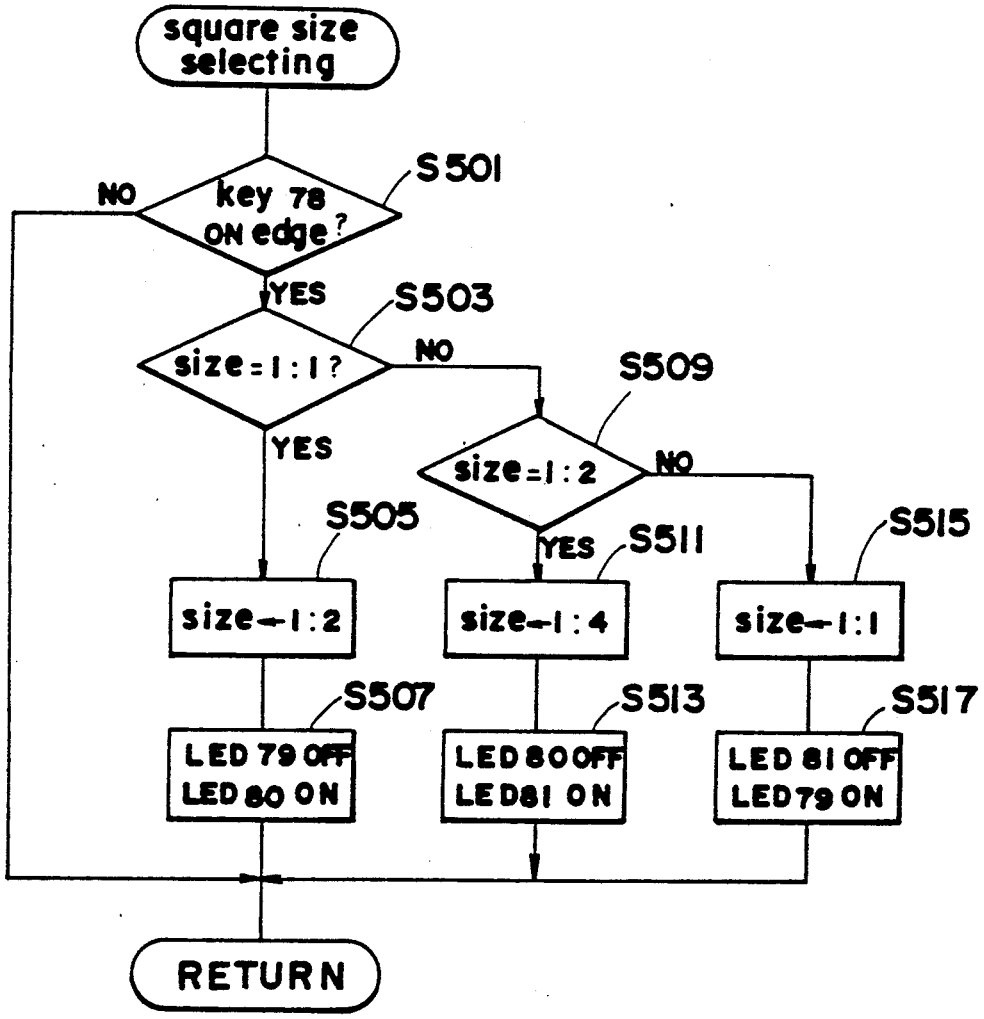
FIG. 10 is a flow chart showing a square size selecting subroutine.

FIG. 10 is a flow chart showing the square size selecting subroutine called in step S212 for selecting the size of the squares to be formed on the copy paper.

With reference to FIG. 4 already described, the square size will be described. The term "square size" refers to the ratio of the width l1 of longitudinal lines extending along the direction of transport of the copying paper for forming a squared pattern thereon to the spacing l2 between the lines. More precisely, the interimage eraser 4 is adapted to form on the surface of the drum 2 a squared pattern in the form of an electrostatic latent image which includes lines (longitudinal lines) extending along the direction (lateral direction in FIG. 4) of rotation of the drum 2. The square size represents the ratio of the width l1 of these lines to the width l2 between the lines. These longitudinal lines are formed by selectively turning off the light-emitting diodes 98*a*, among the diodes 98 constituting the eraser 4, which are positioned at opposite sides of every specified number of (four, in the illustrated case) diodes 98. When the ratio of the line width to the line-to-line spacing is 1:1, one light-emitting diode 98 is positioned between the lines, such that the diodes 98 are turned on and off alternately to give a square size of 1:1. When two diodes are positioned between the lines, the square size is 1:2. The electrostatic latent image thus formed provides longitudinal lines at a specified spacing which extend in the direction of transport of the copying paper, i.e., longitudinally of the copy paper used for the usual operation.

On the other hand, when transverse lines are to be formed on the copying paper perpendicular to the direction of transport thereof, all the light-emitting diodes 98 constituting the inter-image eraser 4 are turned off at a required time interval with the rotation of the drum 2. With the present embodiment, two timers T1 and T2 are used for turning on and off the diodes 98 at such a time interval. More specifically stated with reference to FIG. 4, the diodes 98 other than the diodes 98*a* for forming the longitudinal lines are held on during the counting operation of the timer T1, so that no electrostatic latent image portion is formed on the drum surface for the transverse line. Further during the counting operation of the timer T2, all the diodes 98 of the eraser 4 are held off, forming on the drum surface an electrostatic image portion corresponding to the transverse line. Suppose the width of light projected at this time onto the drum surface by one diode 98 is W mm, and the speed of rotation of the drum 2 is V m/s. The time setting on the timer T2 for counting the time period for forming the transverse line is then expressed by W/V ms. Further the counting time of the timer T1 which determines the period of time during which no transverse line is formed to provide a spacing between the transverse lines varies with the square size specified. When the square size is 1:M, the timer T1 is set to M times the time period to which the timer T2 is set ($T1 = M \times T2$). For example, when the square size is 1:4, the timer T1 is set to four times the time setting for the timer T2.

With reference to FIG. 10 again, step S501 inquires whether the square size selecting key 78 has been depressed. If the key 78 has been depressed, step S503 inquires whether the square size set before the key input was 1:1. If the answer is affirmative, the square size is changed to 1:2 in step S505, the LED 79 is turned off and the LED 80 is turned on in step S507, and the sequence thereafter returns to the main routine. Unless step S501 finds the key 78 depressed, the sequence returns directly to the main routine without any processing.

When the answer to the inquiry of step S503 was negative, step S509 follows to check whether the square size set was 1:2. If the answer to this inquiry is in the affirmative, the square size is changed to 1:4 in step S511, the LED 80 is turned off and the LED 81 is turned on in step S513, and the sequence returns to the main routine.

Further if the answer to the inquire of step S509 is in the negative, this means that the size set before the key input was 1:4 since the setting was neither 1:1 nor 1:2. Accordingly, the square size is changed to 1:1 in step S515, and the LED 81 is turned off and the LED 79 is turned on in step S517, whereupon the sequence returns to the main routine.

Squared Pattern Forming Subroutine

Figure 11:
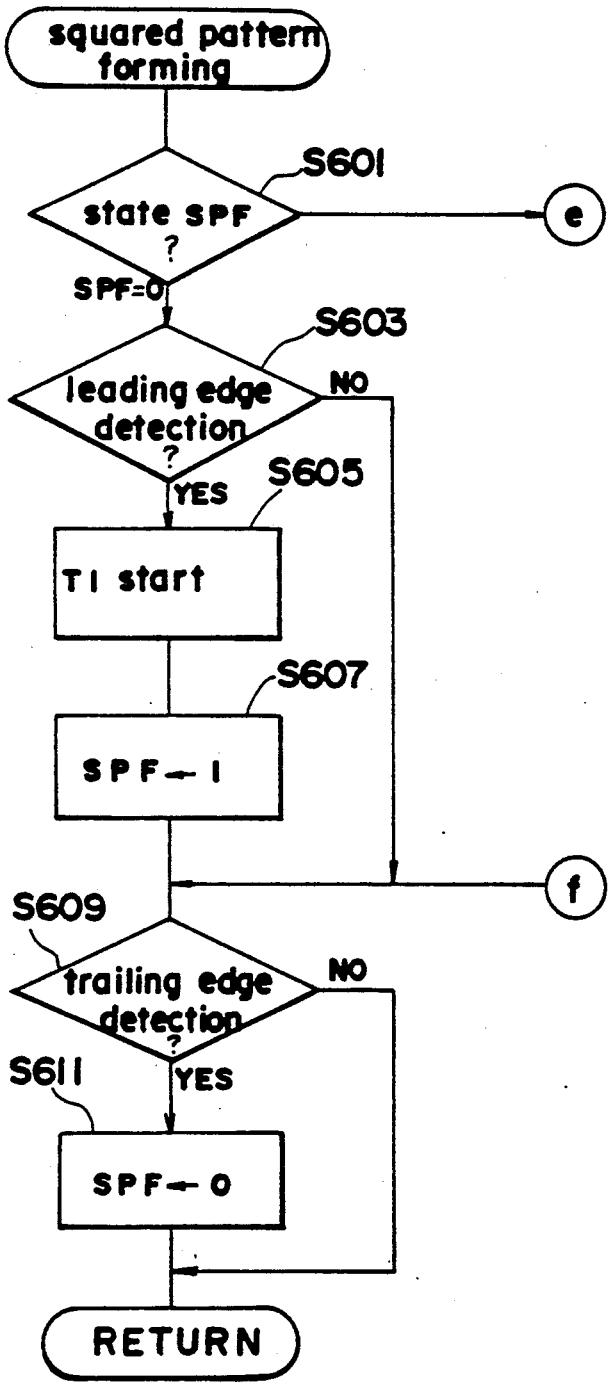
FIGS. 11 (A) and (B) are flow charts showing a squared pattern forming subroutine.
Figure 11B:
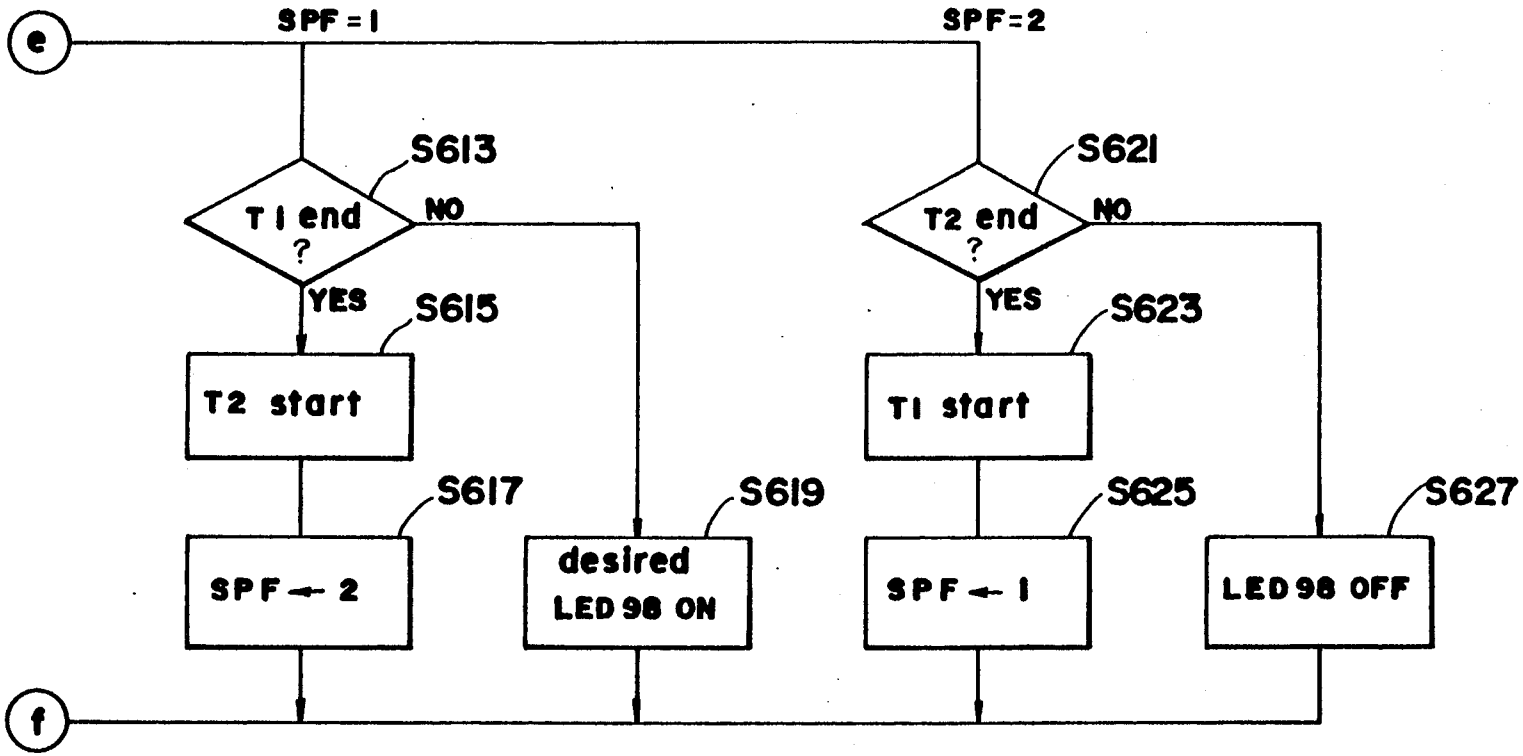

FIGS. 11 (A) and (B) are flow charts showing the squared pattern forming subroutine called in step S129. This subroutine is divided into three states, which are executed in succession.

Step S601 inquires which of "0" to "2" the state SPF is. When the state identified is "0", step S603 inquires whether the paper edge sensor SEP has detected the leading edge of copying paper. When the leading edge has been detected, the timer T1 is set to start its operation in step S605, and the state SPF is set to "1" in step S607. Step S609 then follows which inquires whether the paper edge sensor has detected the trailing edge of the paper. Upon the detection of the edge, the state SPF is reset to "0" in step S611, whereupon the sequence returns to the main routine. Unless step S603 finds the paper leading edge detected, steps S605 and S607 are jumped for the sequence to proceed to step S609. Further unless step S609 finds the paper trailing edge detected, step S611 is jumped for the sequence to return to the main routine.

If the state SPF is found to be "1" in step S601, step S613 inquires whether the operation of the timer T1 has been completed. When the answer is in the affirmative, the timer T2 is set to start its operation in step S615, the state SPF is set to "2" in step S617, and step S607 then follows. If the operation of the timer T1 has not been completed in step S613, step S619 follows in which light-emitting diodes 98 of the eraser 4 are turned on in accordance with the specified squared pattern. Step S609 then follows.

Further when the state SPF is found to be "2" in step S601, step S621 inquires whether the operation of the timer T2 has been completed. If the answer is affirmative, the timer T1 is set to start its operation in step S623, and the state SPF is set to "1" in step S625, which is then followed by step S609. If the operation of the timer T2 has not been completed in step S621, all the diodes 98 of the eraser 4 are turned off in step S627. The sequence then proceeds to step S609.

According to the present embodiment described above, the copying apparatus is settable in the squared pattern copy mode to automatically form a squared pattern of the desired size on plain copying paper and is also adapted to form the squared pattern with a toner of the same color as the paper.

Whereas the conventional apparatus requires preparation of squared paper and replacement of such paper by plain paper for copying operation, the present apparatus is free of this problem. Moreover, the squared pattern can be formed with a toner of a color different from the color of the image superposed thereon, hence the advatange that the image formed is easy to view.

With the embodiment described above, the sixth mirror 39 of the optical system Q is rotated when the squared pattern is to be formed so as to prevent the image of the original illuminated with the exposure lamp 30 from impinging on the surface of the photosensitive drum 2. However, this arrangement is not limitative. For example, the same result as above can of course be achieved, by turning off the exposure lamp 30 or using some other means.

Further with the present embodiment, the leading edge and trailing edge of the copying paper are detected to turn on and off the inter-image eraser 4 at proper time, whereas a copying start signal produced on depression of the print key 61 or some other member starting to operate with the start of copying operation may alternatively be used to determine the timing. Further with the present embodiment, the squared pattern is formed on the copying paper first followed by the usual copying operation as will be apparent from the flow chart of FIG. 5 so as to obviate the likelihood that the squared pattern will produce a fault in the image formed by the usual copying operation. Depending on the contemplated use, nevertheless, this order can be changed; the squared pattern can be superimposed on the image formed first to make the pattern appear emphasized. Furthermore, one of these different orders can be made selectable as desired.

Although the present invention has been fully described by way of example with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. A copying apparatus in which an image of an original document is copied on a paper, the improvement comprising:

a photosensitive member;

a writing head including a plurality of writing elements arranged in a line that extends substantially across the width of the photosensitive member;

driving means for selectively and independently driving the writing elements;

control means for controlling the driving means so as to form an electrostatic image of a grid pattern on the photosensitive member;

developing means for developing the electrostatic image to thereby form a toner image of the grid pattern on the photosensitive member; and transfer means for transferring the toner image of the grid pattern onto the paper, the toner image of the grid pattern being transferred in an overlapping relationship with a toner image corresponding to the latent image of the original document.

2. A copying apparatus as claimed in claim 1, wherein said writing head projects light onto the photosensitive member under control by said control means.

3. A copying apparatus as claimed in claim 2, wherein said writing head includes a plurality of light emitting diodes as said writing elements.

4. A copying apparatus as claimed in claim 1, wherein the size of said grid pattern is variable.

5. A copying apparatus comprising:

a photosensitive member;

a document table for supporting in original document;

an optical means for projecting an image of the original document onto an image area of the photosensitive member;

a writing head including a plurality of writing elements arranged in a line that extends substantially across the width of the photosensitive member, the plurality of writing elements being selectively and independently driven for projecting light onto the photosensitive member, the light projected by the writing head being projected onto the image area of the photosensitive member;

first image forming means for forming a first electrostatic image on the photosensitive member by the optical means;

second image forming means for forming a second electrostatic image of a grid pattern on the photosensitive member by the writing head;

developing means for developing the first and second electrostatic images to thereby form first and second toner images on the photosensitive member; and transfer means for transferring the first and second toner images onto one side of the paper, the first and second toner images being transferred separately from one another in an overlapping relationship.

6. A copying apparatus as claimed in claim 5, wherein said writing head includes a plurality of light emitting diodes as said writing elements.

7. A copying apparatus as claimed in claim 5, further comprising composite copy means for controlling a composite copy in which the first toner image is transferred onto the one side of the paper after transfer of the second toner image thereon.

8. A copying apparatus as claimed in claim 5, further comprising composite copy means for controlling a composite copy in which the second toner image is transferred onto the one side of the paper after transfer of the first toner image thereon.

9. A copying apparatus as claimed in claim 5, wherein said developing means includes a plurality of developing units each accommodating toners of different color.

10. A copying apparatus as claimed in claim 9, wherein said developing means develops the first and second electrostatic images with toners of different color.

11. A copying apparatus as claimed in claim 10, wherein said developing means includes toner color detection means for detecting color of the toner in each developing unit.

12. A copying apparatus as claimed in claim 11, further comprising paper color detection means for detecting color of the paper and developing unit selection means for automatically selecting the developing unit accommodating the toner of the same color as the paper upon development of the second electrostatic image.

13. A copying apparatus as claimed in claim 5, wherein said second image forming means is operable to alter the size of said grid pattern.

14. A copying apparatus comprising:

a photosensitive member;

a document table for supporting an original document;

an optical means for projecting an image of the original document onto an image area of the photosensitive member;

a writing head provided in vicinity of the photosensitive member, the writing head including a plurality of writing elements arranged in a line that extends substantially across the width of the photosensitive member, the plurality of writing elements being selectively and independently driven for projecting light onto the photosensitive member, the light projected by the writing head being projected onto the image area of the photosensitive member;

first image forming means for forming a first electrostatic image according to the original document on the photosensitive member by the optical means;

second image forming means for forming a second electrostatic image of a grid pattern on the photosensitive member by the writing head, while inhibiting the projection of the image of the original document by said optical means;

developing means including a plurality of developing units each accommodating toners of different color for developing the first and second electrostatic images, whereby first and second toner images are formed on the photosensitive member;

toner color detection means for detecting color of the toner in each developing unit;

paper color detection means for detecting color of the paper;

developing unit selection means for automatically selecting the developing unit accommodating the toner of the same color as the paper upon development of the second electrostatic image;

transfer means for transferring the first and second toner images onto one side of the paper; and composite copy means for controlling a composite copy in which one of the first and second toner image is transferred onto the one side of the paper after transfer of the other of the first and second toner image thereon in an overlapping relationship.

15. A copying apparatus as claimed in claim 14, wherein said writing head includes a plurality of light emitting diodes as said writing elements.

16. A copying apparatus as clime din claim 14, further comprising composite copy means for controlling a composite copy in which the second toner image is transferred onto the one side of the paper after transfer of the first toner image thereon.

* * * * *